US006135000A

United States Patent [19]

Caspar et al.

[11] Patent Number: 6,135,000

[45] Date of Patent: Oct. 24, 2000

[54] WEB CUTTING APPARATUS FOR USE IN A PAPERMAKING MACHINE

[75] Inventors: Roman C. Caspar, Beaconsfiled; Dieter H. Hilker, Mascouche Heights, both of Canada

[73] Assignee: Paprima Industries Inc., Lachine, Canada

[21] Appl. No.: 09/275,105

[22] Filed: Mar. 24, 1999

[30] Foreign Application Priority Data

Jan. 25, 1999 [CA] Canada ..... 2260290

[51] Int. Cl.[7] ..... B26F 1/26

[52] U.S. Cl. ..... 83/177; 83/614

[58] Field of Search ..... 83/177, 649, 425.3, 83/499, 353, 614, 53, 936–939; 242/525.5, 525.6, 527.5, 527.6; 162/193, 194, 286

[56] References Cited

U.S. PATENT DOCUMENTS

| | | | |
|---|---|---|---|
| 1,937,360 | 11/1933 | Rosener | 164/60 |
| 3,088,355 | 5/1963 | Hornbostel, Jr. | 83/177 |
| 3,213,735 | 10/1965 | Keferstein et al. | 83/353 |
| 3,226,527 | 12/1965 | Harding | 83/177 |
| 3,625,813 | 12/1971 | Eckelman | 162/286 |
| 4,343,211 | 8/1982 | Volle | 83/177 |
| 4,728,379 | 3/1988 | Audi et al. | 83/177 |
| 5,158,648 | 10/1992 | Weldon | 162/193 |
| 5,234,549 | 8/1993 | Weldon | 162/193 |
| 5,360,179 | 11/1994 | Vesterinen et al. | 242/526.3 |
| 5,582,686 | 12/1996 | Chupka et al. | 83/177 |
| 5,762,759 | 6/1998 | Wedel | 83/177 |
| 5,831,224 | 11/1998 | Wattles et al. | 83/177 |
| 6,001,219 | 12/1999 | Caspar | 83/177 |

FOREIGN PATENT DOCUMENTS

| | | | |
|---|---|---|---|
| 2553330 | 4/1985 | United Kingdom | 83/177 |
| WO 9103359 | 4/1985 | WIPO | 83/177 |

*Primary Examiner*—Rinaldi I. Rada
*Assistant Examiner*—Omar Flores

[57] ABSTRACT

A water jet cutting apparatus for use in a papermaking machine has an elongated support beam that extends across the width of the web. The water jet cutting apparatus utilizes a free spinning hose wheel about which the water jet hose supplying water to a water jet nozzle is guided and stretched. The wheel is mounted for movement with a slower moving carriage along the beam adjacent a faster moving carriage carrying the water jet nozzle. The slower moving carriage moves along the beam at speeds which are one half the speeds at which the faster moving carriage moves across the beam. During this movement of the second slower moving carriage, the wheel reels the hose thereabout to provide a travelling intermediate support for the hose. The hose wheel supports the weight of the hose and maintains it in alignment with the faster moving carriage so that less strain and stress is placed on the hose and the ends of the hose connected to the water jet nozzle during movement of the water jet nozzle across the beam. The water jet cutting apparatus has a preferred application as a tip cutting device in a reel turn-up application in a papermaking machine when two sets of faster and slower moving carriages are arranged for movement on opposite sides of the support beam to move towards each other in directions transverse to the web.

29 Claims, 4 Drawing Sheets

WEB CUTTING APPARATUS FOR USE IN A PAPERMAKING MACHINE

FIELD OF THE INVENTION

The present invention relates to a web cutting apparatus for a papermaking machine and, in particular, to a water jet cutter that traverses along a beam pulling a water supply hose.

BACKGROUND OF THE INVENTION

In the papermaking industry it is becoming more common to use water jet cutting apparatus to cut notches, tails and turn-up tips into the paper web to assist in the re-threading or turn-up of the web in the next section of the papermaking machine.

Water jet tail cutters typically have a beam that extends transversely above and across the width of the web of paper. The beam has a track extending therealong and a drive mechanism for moving a carriage along the track. The carriage has an arm for supporting a water jet nozzle. The nozzle is attached to one end of a pressurized water supply hose. The water supply hose is connected at its other end to a fitting in the beam and the hose rests along the beam. When the hose is pressurized, the water jet nozzle directs a cutting jet or stream of water onto the web to cut through the web. The carriage and the nozzle move across the web to sever the web. As the carriage moves, it pulls or pushes the hose along the beam depending on the direction of movement of the carriage along the beam causing the hose to un-fold or fold in an overlapping position. In other known constructions, the hose is wrapped around a rotating drum. The drum is placed outside one end of the beam and requires a special rotatable water supply fitting connected at one end of the hose to allow the hose to rotate relative to the fitting so as not to twist the hose.

The water jet hoses are typically reinforced with flexible steel braid, and are carried in a relatively heavy "carrier" to protect, carry and guide the hose. When the hose is pressurized with water, it shrinks in length, becomes less flexible and increases in mass. While these characteristics of the pressurized hose have been resolved when the water jet carriage moves relatively slowly along the beam, the inertia associated with accelerating and decelerating the pressurized hose and carrier along the beam to high speeds increase the forces placed on the end connections of the hose and the structure of the hose carrier. Thus, this type of water jet cutting apparatus is not particularly suitable for higher cutting speed applications such as turn-up applications in high speed machines at the dry end of the machine where the speed of movement of the nozzle along the beam and across the web is critical to a successful turn-up of the web onto a new empty reel. Typically there are severe space limitations, in terms of beam length, in which to achieve high travelling speeds. In consequence, extremely high carriage accelerations and decelerations are needed in order to obtain the shortest travelling time within the available track length.

In view of the forgoing, there is a need for an improved water jet cutting apparatus which is able to achieve extremely high acceleration, speeds, and deceleration suitable for use in the turn-up applications of paper making machinery where the speed at which the water jet moves across the web is not hindered by the inertia associated with pulling or pushing a water supply hose along the beam.

SUMMARY OF THE INVENTION

The present invention relates to a web cutting apparatus for cutting a web in a paper making machine where the apparatus has a support beam that is mounted above or below the web and extends transversely across the width of the web. The beam supports a first moving carriage on which is mounted a cutting device, preferably a water jet cutting nozzle. As the first carriage moves along the beam, a water jet sprayed from the nozzle cuts the web. The improvement in the water jet cutting apparatus of the present invention resides in the manner in which the flexible hose is pulled and pushed along the beam by the water jet nozzle and first carriage as the water jet nozzle traverses across the beam. The movement of the hose of the present invention is assisted by a free spinning wheel mounted to a second, slower moving carriage movable along the beam. The hose is guided and stretched in a supported manner about the wheel as the second carriage moves across the beam. The speed of movement of the second carriage along the beam is chosen to be relative to the speed of movement of the first carriage along the beam. As a result, the spinning wheel acts as an intermediate movable support for the weight of the hose during periods of acceleration and deceleration of the water jet nozzle depending on the direction the water jet nozzle is moving relative to the second carriage during the high speed cutting operation. The wheel, by supporting the hose during these periods, reduces the stresses placed on the hose connections to the nozzle and a beam mounted supply fitting. The intermediate movable hose support of the wheel permits the first carriage carrying the water jet nozzle to move across the beam at considerably higher speeds than in the past.

The relative speed of movement of the first and second carriages in the preferred embodiment of the present invention is a ratio of 2:1. In otherwords, the second carriage moves at half the speeds of the first carriage. Alternatively, different speed ratios may be utilized depending on the width of the web to be cut, the speed at which the web is to be cut and the tension to be maintained on the supply conduit during movement of the carriages.

While the preferred cutting device is a water jet cutting nozzle, it is envisaged that any form of cutter suitable for cutting into a web requiring a cutting power or medium supply could be employed. Accordingly, it is within the realm of the present invention that a laser cutting device could be used as an alternative to the water jet cutting nozzle. In this alternative embodiment, the water supply hose could be replaced by one or more hoses for supplying the cutting medium in the form of supply fluids or gasses and electrical power to the laser cutting device.

To effect movement of both the wheel and the water jet nozzle across the beam, the first and second carriages are mounted on a rail extending along the length of the support beam. Each carriage is driven by a separate belt drive to which each carriage is fastened. Alternatively, in some applications a chain may be used. The belts are preferably located adjacent to each other in their longitudinal moving direction. The belts are joined and surround driving pulleys or sprockets located at opposing ends of the beam. In order to coordinate or control the movement of the first, faster moving carriage carrying the water jet nozzle relative to the second, slower moving carriage carrying the wheel, the belts are driven at relative speeds where the second slower carriage preferably moves at ½ the speed, at any instant in time or position along the beam, than the speed at which the first faster moving carriage moves across the beam. As a result, the water jet nozzle and first carriage move twice the distance across the beam than the wheel supporting the hose and the second carriage.

The coordination of the movement of the drive belts requires first and second drive means for driving the first and second carriages where the drive means are interdependent of each other. The synchronization of the speed of movement of the drive belts may be accomplished either by having two separate electric motors drive the belts at different speeds, or preferably, by a transmission mechanism combining the pulleys where the circumference of the pulley driving the second, slower moving, carriage is half that of the pulley that drives the belt that moves the first, faster moving, carriage.

While the application of the water jet cutting apparatus of the present invention may be used in most tail cutting, sheet breaker, or web cutting applications in a papermaking machine, the preferred application of the present invention is for the use as a high pressure water jet cutting apparatus that moves at high speeds to cut a central tip in the web used for turn-up onto an empty reel or core in the reeling section of a paper making machine. In this application, the water jet cutting apparatus is constructed with a beam having two rails. The rails are located preferably in an upstream/downstream orientation relative to the direction of web travel. Alternatively, the rails could be positioned one above the other or spaced apart from each other on separate beams. The rails carry opposing first and second sets of carriages that each include a first, faster moving, carriage and a second, slower moving, carriage. The sets of carriages are located on opposing sides of the beam at opposite ends of the beam. The first faster moving carriages are attached to the same faster moving drive belt and the second slower moving carriages are attached to the same slower moving drive belt. In this application, the water jets are accelerated from opposite ends of the beam on different sides of the beam in direction towards each other in transverse direction of the web. Preferably, the water jets are initially positioned inboard of the edge of the web. As the water jets approach the mid point or center of the beam, the water jets cut through the web cutting into the moving web, thus forming a tip. The water jets continue to cut through and sever the web as the water jet nozzles in the first faster moving carriages traverse across the width of the beam to opposite sides of the beam. To control the start of the cut into the web, the water jets may either be turned on at a set time in the travel of the carriage, or preferably, the jets are started at the beginning of the carriage run outside of the web and a water jet catch tray is located beneath the beam during the first stage of travel of each first carriages to catch the jet spray. Alternatively, the web could be cut by either two water jets moving towards each other from the outside edges of the web 12 or by a single water jet nozzle traversing the entire width of the web by itself.

To further assist the water jet cutting apparatus in cutting through the web, the beam of the water jet cutting apparatus has a flattened surface adjacent the web having a series of apertures through which negative pressure is drawn to pull the web up into engagement or contact with the flattened surface of the beam. This allows for the web to be held in place as the jets cut through the web. A channel is located in the beam immediately below the rail or track, or alternatively, a false bottom is positioned on the beam, to which a vacuum source located at the ends of the beam permit the negative pressure to hold the web through the series of apertures.

There are two alternative methods of holding the web against the force of the cutting jet that may be used with the water jet cutting apparatus of the present invention. One alternative is to cut the web over a roll surface such as the reel bar, or driving drum in a wind-up section of the paper making machine. The second alternative is to use a "table" with slots over which the web can be supported so that the table is located on the opposite side of the web from the water jet cutting apparatus.

In the preferred embodiment, the supply conduit is wrapped ½ a turn, or 180 degrees around the wheel. This has been found to be sufficient to maintain the desired guiding and stretching of the hose about the wheel as the second carriage moves along the beam with the first carriage. It is also envisaged that the supply conduit could be wrapped more than a half turn around the wheel to support the hose. The additional wrapping of the hose about the wheel may change the manner in which the wheel supports the hose during periods of carriage acceleration and deceleration.

In accordance with one aspect of the present invention there is provided a web cutting apparatus for cutting a web in a papermaking machine. The apparatus comprises at least one beam extending transversely across the width of the web and a first carriage mounted to the beam and movable along the beam. A cutting apparatus is mounted to the first carriage for cutting into the web as the first carriage moves along the beam. A flexible supply conduit is connected to the cutting apparatus to supply the cutting apparatus with a medium to effect the cut into the web. The web cutting apparatus has first drive means for driving the carriage along the beam. A second carriage is mounted to the beam and moveable along the beam. A wheel is rotatably mounted on the second carriage for movement therewith along the beam. The wheel is adapted to have the supply conduit guided and stretched thereabout. The wheel reels the conduit as the second carriage moves along the beam. The web cutting apparatus has second drive means for driving the second carriage along the beam. The second drive means is interdependent with the first drive means to move the second carriage along the beam at speeds that are relative to the speeds at which the first drive means moves the first carriage along the beam.

BRIEF DESCRIPTION OF THE DRAWINGS

For a better understanding of the nature and objects of the present invention reference may be had to the accompanying diagrammatic drawings in which.

DETAILED DESCRIPTION OF THE DRAWINGS

Figure 1:
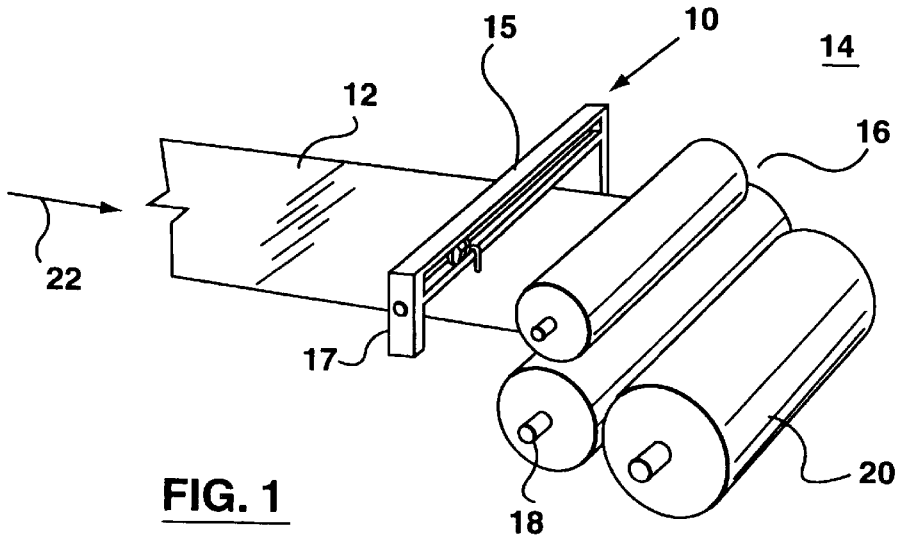
FIG. 1 is a perspective view showing the water placement of the water jet cutting apparatus in a dry end of a paper making machine prior to turn up of the web onto a new reel
Figure 2:
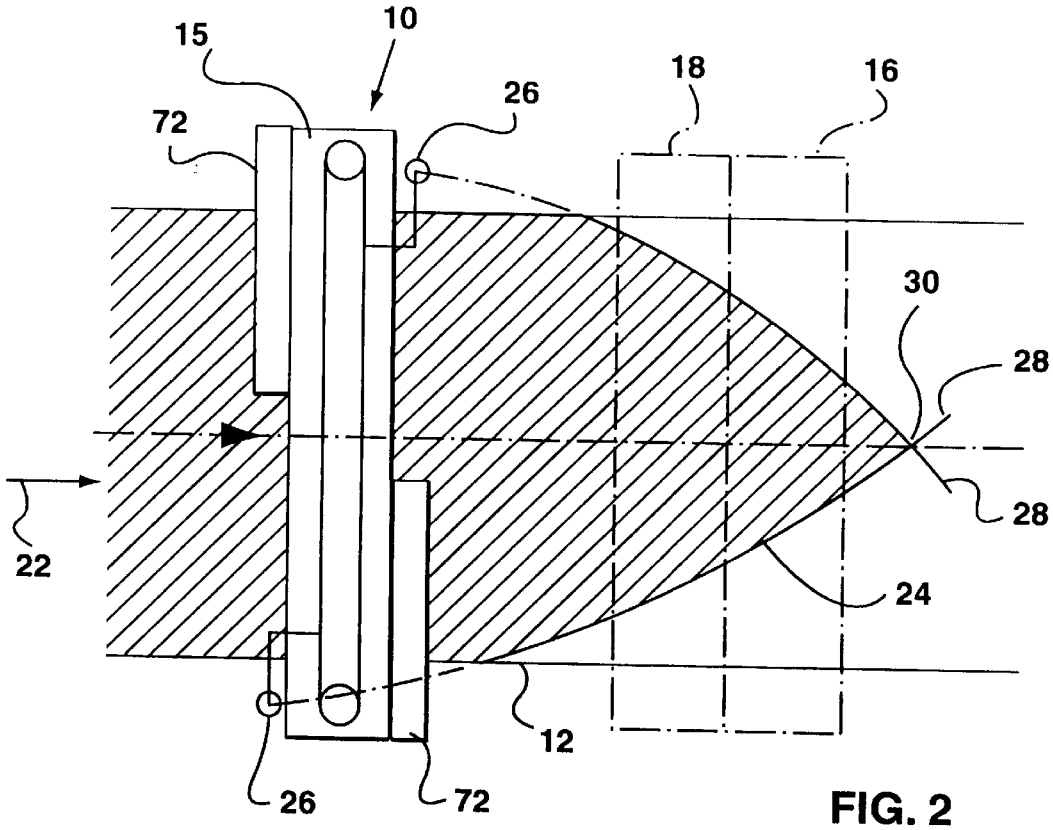
FIG. 2 is a plan view showing the pattern of cut in the web made by the water jet apparatus of the preferred application of the present invention.

Referring now to FIGS. 1 and 2 there is shown the water jet cutting apparatus 10 of the present invention for a web 12 in a papermaking machine 14. The water jet cutting apparatus 10 is shown in its preferred application at the reel of the papermaking machine 14 for cutting a turn-up tip that is fed onto a new winding spool 16. Prior to cutting the web 12, the web 12 is driven by driving drum reel 18 onto an existing winding spool 20.

The water jet cutting apparatus 10 has an elongated beam 15 which extends transversely across the width of the paper web 12. The beam 15 is supported above a top surface of the web 12 by side supports 17 for each of which only a portion is shown. Alternatively, the beam 15 may be positioned below the web 12 to cut up into the web 12. As the web 12 travels in the direction of arrow 22, beneath the water jet cutting apparatus 10, the water jet cutting apparatus 10 is operated to cut a pattern similar to that shown in the shaded area 24 of FIG. 2.

The water jet nozzles 26 are located on opposite sides of the beam 15 in the direction 22 of paper travel. The water jet nozzles 26 make an initial cut into the paper at 28 forming tip 30. The pattern 28 is cut into the web as the web 12 moves in the direction of arrow 22 and the water jet nozzles 26 move to the outside edges of web 12 along the beam 15 to thereby sever the web 12. It should be understood that the cutting pattern 28 is a preferred cutting pattern and that the cuts into the web could be made from either two water jets moving towards each other from the outside edges of the web 12, or by a single water jet nozzle traversing the entire width of the web by itself.

Referring to FIGS. 3 to 6, the principle of operation of the water jet cutting apparatus is shown. The components comprising the water jet cutting apparatus 10 are not shown to scale in these Figures. The water jet apparatus 10 includes a beam 15 mounted on support stands 17. The beam 15 extends across the width of web 12. The length of the beam 15 is typically anywhere from 15 to 35 feet.

The beam 15 has tracks or guide rails 31 mounted on opposite sides of the beam in the direction 22 of travel of the web 12. The apparatus 10 has first and second carriage sets 32, 34 (FIG. 5) that are mounted on opposing sides of the beam to a corresponding one of the tracks 31 for movement therealong and along the beam.

Each of the first and second carriage sets 32, 34 has a first faster moving carriage 36 and a second slower moving carriage 38. The first faster moving carriage 36 of each of the carriage sets 32, 34 has mounted thereto cutting apparatus 40 for supporting one of the nozzles 26 relative to the first or first faster moving carriage 36.

Each of the second slower moving carriages 38 has a hose wheel 42 mounted to the carriage for free rotation about axis 44 as the carriage 38 moves along the track 31. A water supply conduit hose 46 extends from one end of the beam adjacent the track 31 and is guided and stretched 180 degrees about the wheel 42. Hose 46 is connected at one end to the cutting apparatus 40 mounted to the first faster moving carriage 36 and is connected at its other end to a clamp fitting 48 located in a bulkhead 49 of the beam 15. The hose is held at the bottom end in a clamp which is tensioned by a spring. This clamping of the hose 46 accommodates for hose shrinkage when the hose is pressurized. The clamp 48 holds and pretensions the hose 46 so that hose 46 is in contact with the wheel 42 at all times. Pressurized water is supplied along the flexible steel reinforced hose 46 to the water jet nozzle 26.

Figure 5:
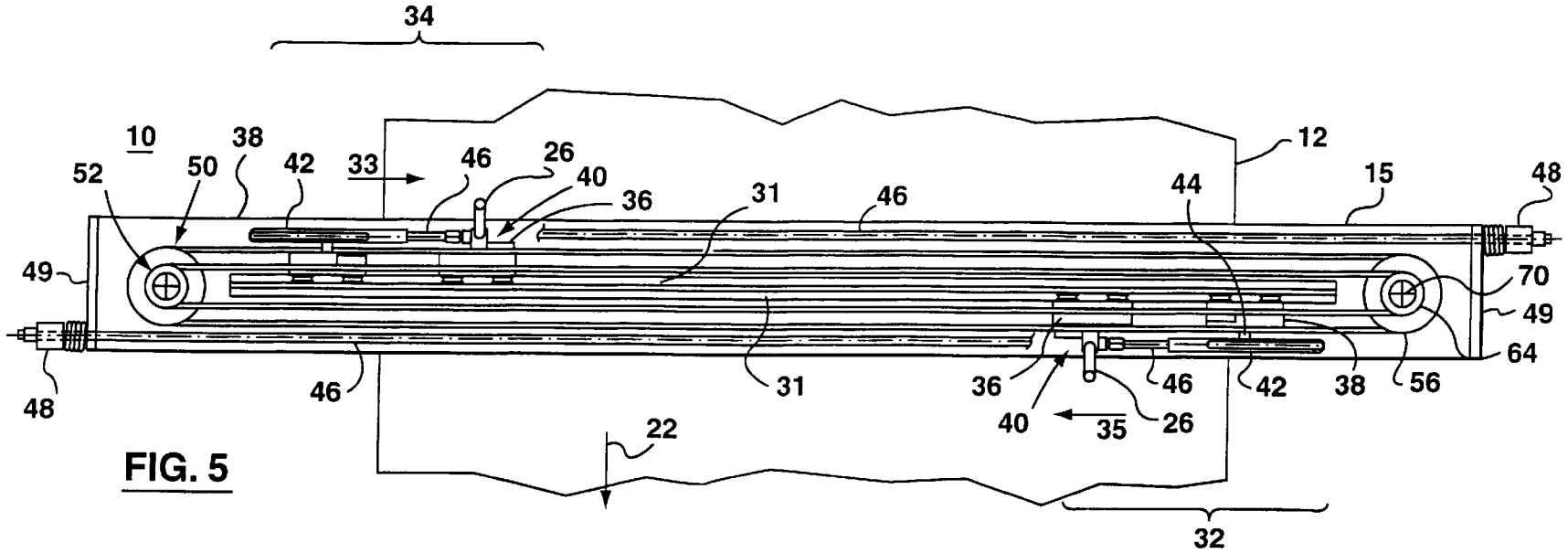
FIGS. 5 and 6 are top sectional views of the water jet cutting apparatus shown in different positions.

As seen in FIG. 5, each of the first and second carriage sets 32 and 34 are moved in the direction of opposing arrows 33 and 35, respectively in precise displacement by means of first drive means 50 and second drive means 52. The first drive means 50 includes a first movable belt 54 that extends along the beam 15 and is looped at the ends of the beam 15 around first pulleys 56. The first carriages 36 of each of the sets 32 and 34 of carriages are mounted or secured to the belt 54. The rotation of the first belt 54 around pulleys 56 is driven by power synchronized electric motors 60. Alternatively only one motor may be used to drive one set of the pulleys.

Figure 6:
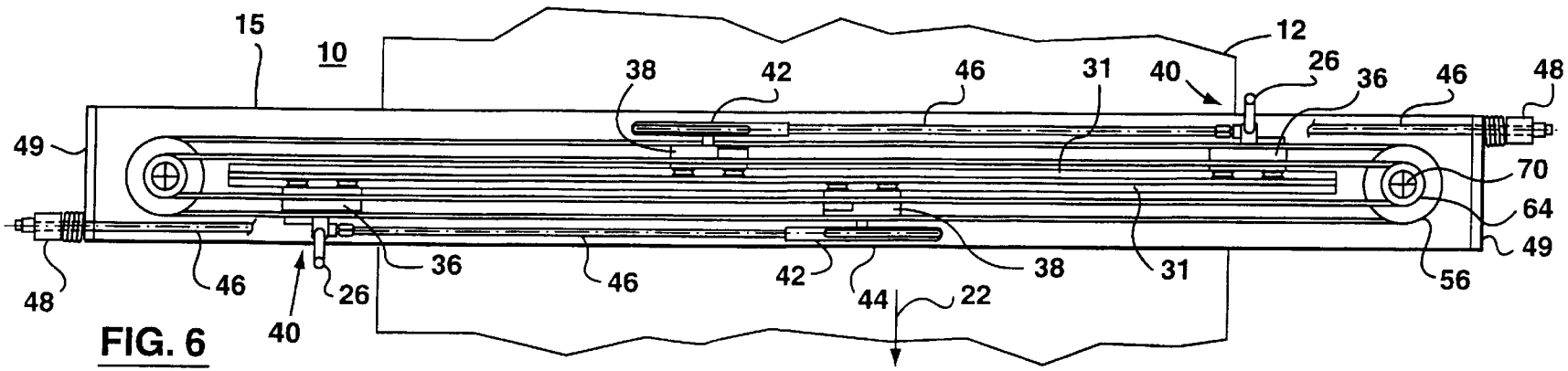

The second drive means 52 includes a second belt 62 extending along the beam 15 and around pulleys 64 located at opposing ends of the beam 15. The second carriages 36 are secured to the belt 62 for movement therewith. The pulleys 64 are mounted through shaft 70 to the motors 60. The first drive means 50 moves the first faster moving carriages 36 at speeds twice as fast as the speeds at which the second drive means 52 moves the second or second slower moving carriages 38. This is accomplished by having the circumference of pulleys 64 chosen to be one half that of pulleys 56. As a result, as the first faster moving carriage 36 moves across the web 12, the second slower moving carriage 38 travels one half the distance to the center of the beam 15 as shown in FIGS. 4 and 6.

Figure 3:
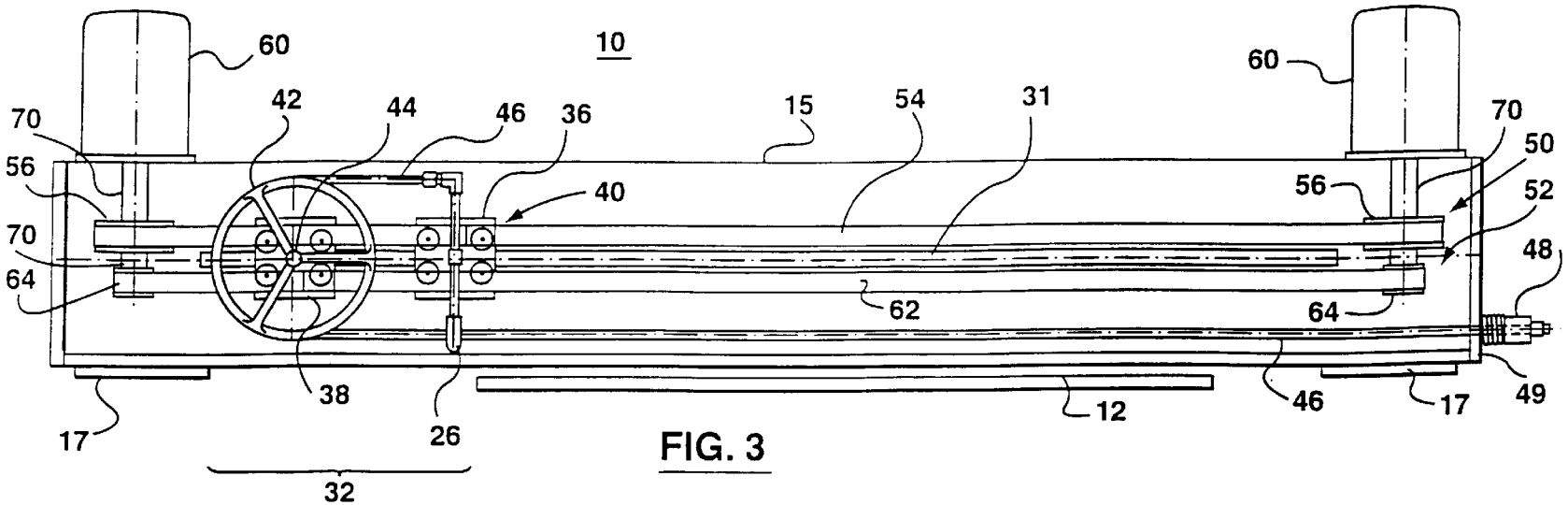
FIGS. 3 and 4 are side view showing the water jet cutting apparatus of the present invention in two different positions.

In FIG. 3, the first carriage 36 and the second carriage 38 are shown positioned on the left of the beam 15. In this position, the hose 42 is wound around the wheel 42 and extends along the bottom of the beam 15 back towards the other end of the beam 15. In this position, very little weight of the hose is now carried by the connection to the water jet cutting apparatus 40. At this point, the water jets 26 are turned on and caught by the catch tray 72 (FIG. 2). The first and second carriages are then accelerated to the right as shown in FIG. 4. As the water jet nozzle 26 passes the end of the catch tray 72, the water jet cuts into the web passing beneath the water jet cutting apparatus 10.

Figure 4:
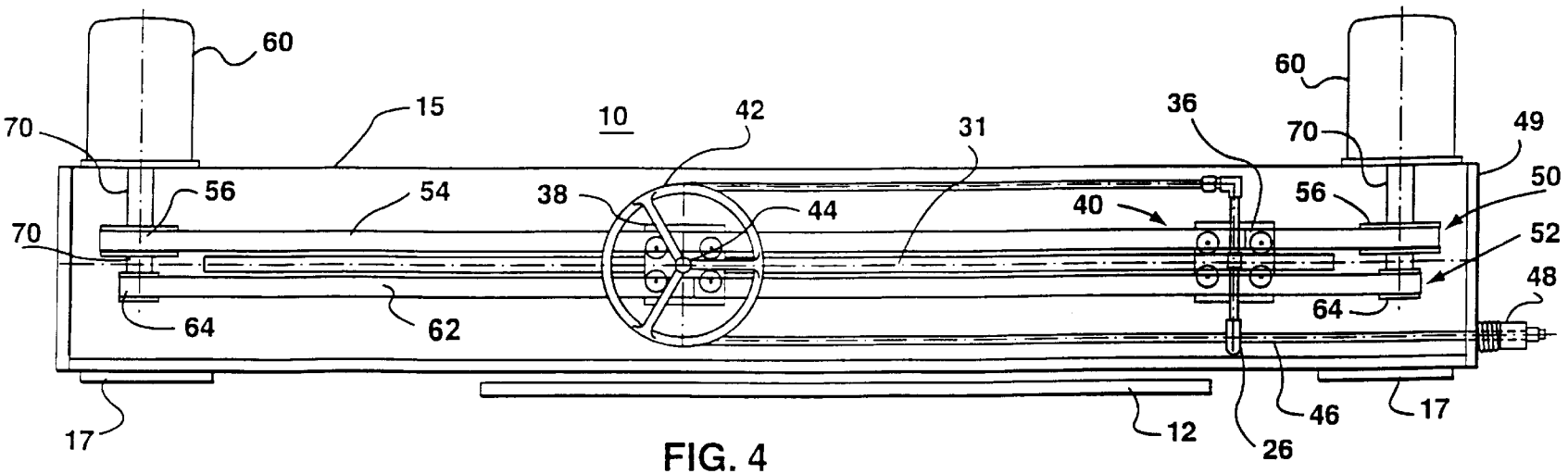

In the position shown in FIG. 4, the hose 46 is wrapped around the wheel 42 and passes back to the end fitting 74 shown in the right of FIG. 4. When carriage 38 carrying wheel 42 decelerates to this position a substantial portion of the momentum of the hose 46 is taken up by the wheel 42. This reduces the load placed on the connection to the cutting apparatus 40 found on the faster moving carriage 36.

Figure 7:
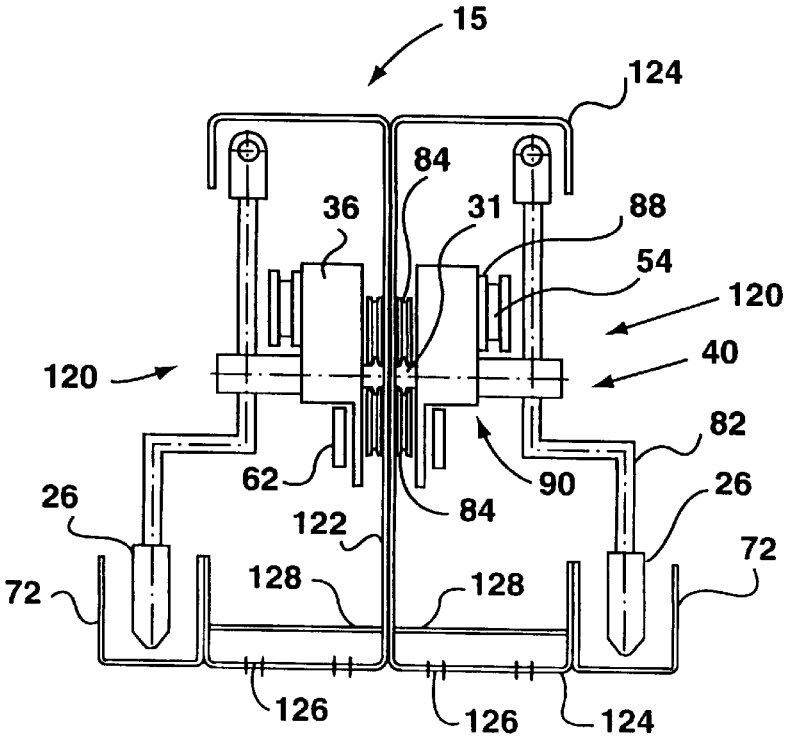
FIG. 7 is a side view showing the faster moving carriages of the water jet cutting apparatus; and, FIG. 8 is a side view showing the slower moving carriages and wheels of the water jet cutting apparatus.

Referring to FIG. 7, there is shown a partial cross-section of the first carriage mounted for movement along the beam 15. It should be understood that in FIG. 7, this is a mirror image of the water jet cutting nozzles 26 taken at the center of the beam as the nozzles 26 are passing each other and are initiating the cut through the web. Each of the carriages 36 has the cutting apparatus 40 mounted. The water jet nozzles 26 are supported by a support arm 82 relative to the carriage 36. The carriage 36 is mounted to grooved wheels 84. Wheels 84 are located on opposing sides of each of the rails 31. The carriage 36 has brackets 88 that sandwich the first belt 54 and secure the carriage 36 relative to the first belt 54. These brackets 88 have two functions. On one carriage 36 the brackets clamp the belt to the carriage. On the other carriage 36, two sets of brackets are located beside each other. One set of brackets is used to clamp one end the belt to the carriage. The other set of brackets co-operate with tightening fasteners (not shown) to tension the belt 62 and secure the tensioned belt to carriage 38. Thus, as the first belt 54 moves along the beam 15 the carriage 36 is moved with this belt. The carriage 36 includes a recessed or cut out section 90 which permits for the second belt 62 to pass relative to the carriage without touching the carriage or pulling the first carriage 36. Bracket 88 is used to tension belt 54

Figure 8:
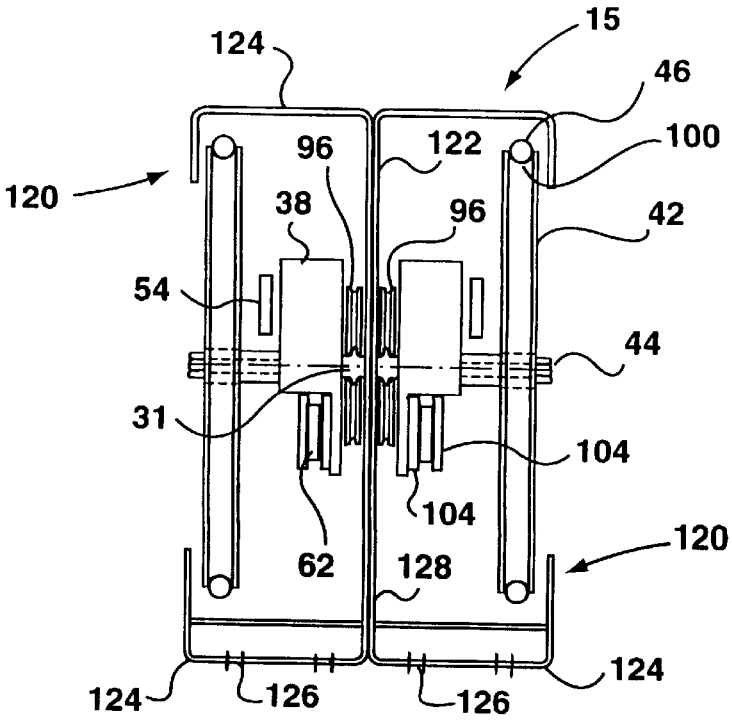

Referring to FIG. 8, a sectional view of the second carriage 38 is shown where the wheels 42, of the second carriage 38, are located in a center beam position shown in FIG. 6. The carriage 38 is mounted at a shaft 44 to rotating wheel 42. Rotating wheel 42 has one groove 100 around which the hose 46 travels. The carriage 38 has rotatable grooved wheels 96 which are also mounted on opposing sides of a respective rail 31. The carriage 38 further includes two brackets 104 which sandwich or secure belt 62 relative to the carriage 38. These brackets 104 also have two functions. On one carriage 38 the brackets clamp the belt to the carriage. On the other carriage 38, two sets of brackets are located beside each other. One set of brackets is used to clamp one end of the belt to the carriage. The other set of brackets co-operate with tightening fasteners (not shown) to tension the belt 62 and secure the tensioned belt to carriage 38. In this fashion, as the belt 62 moves along, or relative to the rail or track 31, the carriage 38 rides the rail and is pulled along the rail 31. As shown, the carriage 38 is mounted on rail 31 to the belt 54 to pass freely relative thereto.

In the event additional control over the reliability assurance of operation of the water jet cutting apparatus was required, two hoses 42 along with 2 nozzles 26 could be run in parallel to the faster moving carriage 36 and connected through a suitable valve, or switching means to the water jet cutting nozzle 26. In this embodiment, the wheel 42 would have two grooves 100 around each of which separate water supply hoses 46 would be looped.

Referring to both FIGS. 7 and 8, the beam 15 is shown to comprise two U-shaped channel sections 120 each having an internal wall 122 with curved end walls 124. This may also be constructed of another type of structural member such as an "I" beam. The lower wall 124 has a series of apertures 126 and an overlapping enclosing wall 128 through which a vacuum is drawn to provide a negative air flow pressure along the bottom surface 124 of the beam 15. This allows the web 12 to be drawn up against the bottom surface of the beam 15.

In FIG. 3, both carriages 36 and 38 are parked at the left beside each other. When the carriages 36 and 38 are accelerated from this position to the right, the faster moving carriage 36 increases its distance from the slower moving carriage 38 and thereby begins to pull the hose 46 increasing the weight of the hose between the faster moving carriage 36 and the slower moving carriage 38. When the faster moving carriage 36 begins to decelerate, the inertia of the hose normally causes the hose to keep moving at a speed that would cause the hose to buckle or stress its connection with the carriage 36. However, in the present invention, the wheel 42 is placed exactly at the radius of where the hose is bending and thereby catches the weight of the hose 46. As braking is applied to the faster moving carriage 36, the inertia of the hose continually tries to move it forward, still at high speed, and the wheel 42 simply catches all the weight of the hose 46 putting virtually zero load on the neck of the hose 46 at the first carriage 36, until the carriages 36 and 38 come to a full stop. This is the preferred manner in which the carriages 36, 38 move to effect a cut into the web.

Alternatively, if the first and second carriages 36, 38 are in the parked position of FIG. 4, and are accelerated from the right to left in this drawing, then the faster moving carriage 36 has to push the weight of the hose 46 along the beam 15. As the carriages 36, 38 accelerate to the left the hose is a very thin cord and normally tends to buckle, but the wheel 42 is also accelerating and is always located at the natural center of the point at which the hose bends. As the second carriage moves to the left and the wheel spins, the wheel carries the entire weight of the moving portion of the hose 46. The wheel 42 continues to carry that weight of the hose 46 until the point at which it begins to decelerate—optimally in the mid point of it's travel. At this point the weight of the hose 46 is no longer carried by the wheel because it is on the outside curb of the wheel. The inertia of the hose 46 during deceleration in this direction, is pulling principally on the neck of the hose on carriage 36. This is why this is not the preferred direction of maximum deceleration.

In any event, depending on the direction of movement of the first and second carriages 36, 38 to effect a cut into the web, the wheel 42 spins to allow for the hose 46 to move with faster moving carriage 36 while the slower moving carriage 38 supports the weight of the hose over at least a portion of the travel of the carriages along the beam. In so doing the hose wheel supports the weight of the hose 46 and maintains it in alignment with the first carriage 36 so that less strain and stress is placed on the ends of the hose.

It should be understood that alternative embodiments of the present invention may be readily apparent to a man skilled in the art in view of the above description for the preferred embodiments of this invention. Accordingly, the scope of the present invention should not be limited to the teachings of the preferred embodiments and should be limited to the scope of the claims that follow.

What is claimed is:

1. A water jet cutting apparatus for cutting a web, having a first width, in a papermaking machine, the apparatus comprising:

a beam extending transversely across the first width of the web;

a first carriage mounted to the beam and movable along the beam;

a water jet cutter mounted to the first carriage and having a nozzle positioned for cutting into the web as the first carriage moves along the beam;

a flexible water supply conduit connected to said water jet cutter to supply pressurized water to the water jet nozzle;

first drive means for driving the first carriage along the beam;

a second carriage mounted to the beam and moveable along the beam;

a wheel rotatably mounted on the second carriage for movement therewith along the beam, the wheel adapted to have the flexible water supply conduit guided and stretched thereabout, the wheel supporting the flexible water supply conduit as the second carriage moves along the beam; and, second drive means for driving the second carriage along the beam, the second drive means being interdependent with the first drive means to move the second carriage along the beam at second speeds that are relative to first speeds at which the first drive means moves the first carriage along the beam.

2. The water jet cutting apparatus of claim 1 wherein the beam has a second width and wherein the first drive means moves the first carriage across the second width of the beam at the first speeds that are twice the second speeds at which the second drive means moves the second carriage along the beam.

3. The water jet cutting apparatus of claim 1 wherein the beam includes a first track along which both the first and second carriages move.

4. The water jet cutting apparatus of claim 1 wherein:

the first drive means includes a first movable belt extending around the beam, the first carriage being attached to the first movable belt;

a pair of first drive transmission pulleys mounted at opposing ends of the beam around which the first movable belt is driven, and the first drive pulleys each having a first circumference;

the second drive means includes a second movable belt extending around the beam adjacent the first movable belt, the second carriage being attached to the second movable belt;

a pair of second drive transmission pulleys mounted at the opposing ends of the beam around which the second movable belt is driven, and the second drive pulleys each having a second circumference that is ½ the first circumference of each of the first drive pulleys; and, a drive motor mounted to at least one of the opposing ends of the beam to drive a corresponding one of the first and second pulleys.

5. The water jet cutting apparatus of claim 4 wherein each of the first and second pulleys located at each opposing end of the beam are driven by a single drive shaft.

6. The water jet cutting apparatus of claim 5 wherein the first and second pulleys located at each opposing end of the beam are initially rotatable relative to each other for initial adjustments and are locked in place relative to each other during operation.

7. The water jet cutting apparatus of claim 1 wherein the flexible water supply conduit has a first end connected to said cutter and has a second end connected to a water supply fitting located adjacent an end of the beam, the water supply fitting having a spring clamp to compensate for hose shrinkage while maintaining a nominal tension on the hose.

8. The water jet cutting apparatus of claim 1 wherein the beam has a wall adjacent the web that has apertures through which a negative pressure is drawn to pull the web against the wall of the beam.

9. A water jet cutting apparatus for cutting a turn-up tip in a web, having a width, of a papermaking machine, the apparatus comprising:

a beam extending transversely across the width of the web;

first and second carriage sets mounted on opposing sides of the beam for movement along the beam in opposite transverse directions;

each of the first and second carriage sets having a faster moving carriage and a slower moving carriage;

a water jet cutter mounted to the faster moving carriage of each of the first and second carriage sets, the water jet cutter each having a water jet nozzle positioned for cutting into the web as the respective faster moving carriage moves along the beam;

flexible water supply conduits connected to the water jet cutter to supply pressurized water to corresponding ones of the water jet nozzles;

hose carrying wheels mounted for rotation to each of the slower moving carriages for movement therewith along the beam, each of the hose wheels having one of the water supply conduits guided and stretched thereabout, each of the hose wheels supporting the one water supply conduits as its slower moving carriage moves along the beam;

first drive means for driving the faster moving carriages along the beam in opposing transverse directions to each other; and, second drive means for driving the slower moving carriages along the beam in opposing transverse directions to each other, the second drive means being interdependent with the first drive means to move the slower moving carriages along the beam at second speeds that are relative to first speeds at which the first drive means moves the faster moving carriage along the beam.

10. The water jet cutting apparatus of claim 9 wherein the first drive means moves the faster moving carriage across the beam at the first speeds that are twice the second speeds that the second drive means moves the slower moving carriage across the beam.

11. The water jet cutting apparatus of claim 9 wherein the beam includes a track on both sides of the beam along which respective sides the first and second carriage sets move.

12. The water jet cutting apparatus of claim 9 wherein:

the first drive means includes a first movable belt extending around the beam, the faster moving carriage being attached to the first movable belt;

a pair of first transmission pulleys mounted at opposing ends of the beam around which the first movable belt is driven, and the first drive pulleys each having a first circumference;

the second drive means includes a second movable belt extending around the beam adjacent the first movable belt, the slower moving carriage being attached to the second movable belt;

a pair of second transmission pulleys mounted at the opposing ends of the beam around which the second movable belt is driven, and the second drive pulleys each having a second circumference that is ½ that of the first circumference of each of the first drive pulleys; and, a drive motor mounted to at least one of the opposing ends of the beam to drive a corresponding one of the first and second pulleys.

13. The water jet cutting apparatus of claim 12 wherein each of the first and second pulleys located at each opposing end of the beam are driven by a single drive shaft.

14. The water jet cutting apparatus of claim 13 wherein the first and second pulleys located at each opposing end of the beam are initially rotatable relative to each other for initial adjustments and are locked in place relative to each other during operation.

15. The water jet cutting apparatus of claim 9 wherein the water supply conduit has a first end connected to said cutter and has a second end connected to a water supply fitting located adjacent an end of the beam, the water supply fitting having a spring clamp to compensate for hose shrinkage while maintaining a nominal tension on the hose.

16. The water jet cutting apparatus of claim 9 wherein the beam has a wall adjacent the web that has apertures through which a negative pressure is drawn to pull the web against the wall of the beam.

17. The water jet cutting apparatus of claim 9 wherein a water jet catch tray is located at opposing sides and ends of the beam for preventing the water jet from contacting the web as the water jet moves with its respective faster moving carriage along the beam over the catch tray.

18. The water jet cutting apparatus of claim 9 wherein the hose wheel is a grooved wheel.

19. A web cutting apparatus for cutting a web in a papermaking machine, the apparatus comprising:

at least one beam extending transversely across the web;

a first carriage mounted to the beam and movable along the beam;

a cutter mounted to the first carriage for cutting into the web as the first carriage moves along the beam;

a flexible conduit connected to said cutter to supply the cutter with a cutting medium;

first drive means for driving the first carriage along the beam;

a second carriage mounted to the beam and moveable along the beam;

a wheel rotatably mounted on the second carriage for movement therewith along the beam, the wheel adapted to have the flexible conduit guided and stretched thereabout, the wheel supporting the flexible conduit as the second carriage moves along the beam; and, second drive means for driving the second carriage along the beam, the second drive means being interdependent with the first drive means to move the second carriage along the beam at second speeds relative to the first speeds at which the first drive means moves the first carriage along the beam.

20. The web cutting apparatus of claim 19 wherein the first drive means moves the first carriage across the beam at the first speeds that are twice the second speeds at which the second drive means moves the second carriage along the beam.

21. The web cutting apparatus of claim 19 wherein the beam includes a first track along which both the first and second carriages move.

22. The web cutting apparatus of claim 19 wherein:

at least one beam is a single beam construction;

the first drive means includes a first movable belt extending around the beam, the first carriage being attached to the first movable belt;

a pair of first drive transmission pulleys mounted at opposing ends of the beam around which the first movable belt is driven;

the second drive means includes a second movable belt extending around the beam adjacent the first movable belt, the second carriage being attached to the second movable belt;

a pair of second drive transmission pulleys mounted at the opposing ends of the beam around which the second movable belt is driven, and the second drive pulleys each having a second circumference that is ½ of a first circumference of each of the first drive pulleys; and, a drive motor mounted to at least one of the opposing ends of the beam to drive a corresponding one of the first and second pulleys.

23. The web cutting apparatus of claim 22 wherein each of the first and second pulleys located at each opposing end of the beam are driven by a single drive shaft.

24. The web cutting apparatus of claim 23 wherein the first and second pulleys located at each end of the beam are initially rotatable relative to each other for initial adjustments and are locked in place relative to each other during operation.

25. The web cutting apparatus of claim 19 wherein the flexible conduit has a first end connected to said cutter and has a second end connected to a supply fitting located adjacent one of the opposing ends of the beam, the supply fitting having a spring clamp to compensate for hose shrinkage while maintaining a nominal tension on the hose.

26. The web cutting apparatus of claim 19 wherein the beam has a wall adjacent the web that has apertures through which a negative pressure is drawn to pull the web against the wall of the beam.

27. The web cutting apparatus of claim 19 wherein the flexible conduit is looped around the wheel by 180 degrees.

28. The web jet cutting apparatus of claim 9 wherein the flexible conduit is looped around the wheel by 180 degrees.

29. The web jet cutting apparatus of claim 1 wherein the flexible conduit is looped around the wheel by 180 degrees.

* * * * *